US011192000B2

(12) United States Patent
Sullivan et al.

(10) Patent No.: US 11,192,000 B2
(45) Date of Patent: Dec. 7, 2021

(54) METHODS FOR MAKING GOLF BALL COVERS BASED ON LIQUID ETHYLENE-PROPYLENE DIENE COPOLYMER RUBBERS AND RESULTING BALLS

(71) Applicant: Acushnet Company, Fairhaven, MA (US)

(72) Inventors: Michael J. Sullivan, Old Lyme, CT (US); David A. Bulpett, Boston, MA (US); Brian Comeau, Berkley, MA (US); Robert Blink, Newport, RI (US); Mark L. Binette, Mattapoisett, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 16/159,158

(22) Filed: Oct. 12, 2018

(65) Prior Publication Data

US 2019/0046841 A1 Feb. 14, 2019

Related U.S. Application Data

(60) Division of application No. 15/231,872, filed on Aug. 9, 2016, now Pat. No. 10,099,090, which is a (Continued)

(51) Int. Cl.
*A63B 37/06* (2006.01)
*A63B 37/02* (2006.01)
(Continued)

(52) U.S. Cl.
CPC ..... *A63B 37/02* (2013.01); *A63B 37/0024* (2013.01); *A63B 37/0031* (2013.01); *A63B 37/0032* (2013.01); *A63B 37/0039* (2013.01); *A63B 37/0043* (2013.01); *A63B 37/0051* (2013.01); *A63B 37/0062* (2013.01); *A63B 37/0075* (2013.01); *A63B 37/0076* (2013.01); *A63B 37/0092* (2013.01); *A63B 45/00* (2013.01)

(58) Field of Classification Search
CPC ..... A63B 37/0024
USPC ..... 473/378
See application file for complete search history.

(56) References Cited

U.S. PATENT DOCUMENTS 3,384,612 A 5/1968 Brandt et al.
3,410,928 A 11/1968 Baum
(Continued)

*Primary Examiner* — Raeann Gorden
(74) *Attorney, Agent, or Firm* — Margaret C. Barker

(57) ABSTRACT

Methods for making multi-piece golf balls comprising at least one component made of ethylene-propylene diene copolymer (EPDM) rubber and the resulting balls are provided. The multi-piece golf ball includes a cover, preferably a dual-cover having inner and outer cover layers. The outer cover is preferably made of a liquid rubber composition based on liquid EPDM rubber. In one version, the ball sub-assembly is dipped in a bath containing liquid EPDM rubber to form the outer cover. In another version, a casting method is used and the liquid EPDM rubber is dispensed into mold cavities to form the outer cover. The inner core of the ball may be made of polybutadiene rubber and the outer core layer may be made of EPDM rubber. The resulting golf ball has high resiliency, a soft feel, and good weatherability.

14 Claims, 2 Drawing Sheets

Related U.S. Application Data continuation-in-part of application No. 13/084,126, filed on Apr. 11, 2011, now abandoned, which is a continuation-in-part of application No. 12/717,543, filed on Mar. 4, 2010, now Pat. No. 8,678,951.

(51) Int. Cl.
*A63B 37/00* (2006.01)
*A63B 45/00* (2006.01)

(56) References Cited

U.S. PATENT DOCUMENTS

| | | | | |
|---|---|---|---|---|
| 3,454,676 | A | 7/1969 | Busse | |
| 5,314,187 | A | 5/1994 | Proudfit | |
| 5,407,998 | A | 4/1995 | Horiuchi et al. | |
| 5,710,218 | A | 1/1998 | Nakahama et al. | |
| 5,857,926 | A | 1/1999 | Sullivan et al. | |
| 6,303,704 | B1 | 10/2001 | Nesbitt | |
| 6,620,061 | B1 | 9/2003 | Ichikawa et al. | |
| 7,402,271 | B2 | 7/2008 | Morgan | |
| 7,423,086 | B2 | 9/2008 | Kim et al. | |
| 7,654,918 | B2 | 2/2010 | Bartsch et al. | |
| 2003/0158340 | A1 | 8/2003 | Iwami | |
| 2004/0214661 | A1* | 10/2004 | Sullivan | A63B 37/0003 473/371 |
| 2010/0331111 | A1 | 12/2010 | Sullivan et al. | |
| 2015/0111667 | A1* | 4/2015 | Sullivan | A63B 37/0063 473/373 |
| 2015/0231450 | A1* | 8/2015 | Sullivan | A63B 37/0076 473/373 |

* cited by examiner

METHODS FOR MAKING GOLF BALL COVERS BASED ON LIQUID ETHYLENE-PROPYLENE DIENE COPOLYMER RUBBERS AND RESULTING BALLS

CROSS-REFERENCE TO RELATED APPLICATIONS

This application is a divisional of co-pending, co-assigned U.S. patent application Ser. No. 15/231,872 having a filing date of Aug. 9, 2016, now allowed, which is a continuation-in-part of co-assigned U.S. patent application Ser. No. 13/084,126 having a filing date of Apr. 11, 2011, now abandoned, which is a continuation-in-part of U.S. patent application Ser. No. 12/717,543 having a filing date of Mar. 4, 2010, now issued as U.S. Pat. No. 8,678,951 with an issue date of Mar. 25, 2014, the entire disclosures of which are hereby incorporated by reference.

BACKGROUND OF THE INVENTION

Field of the Invention

The present invention generally relates to methods for making multi-piece golf balls and more particularly to golf balls having at least one component made of a liquid rubber composition comprising liquid ethylene-propylene diene copolymer (EPDM) rubber. The invention also includes the resulting multi-piece golf ball. The ball includes an inner core, preferably a dual-core containing a center and surrounding outer core layer. The ball further includes a cover, preferably a dual-cover having inner and outer cover layers. The outer cover preferably is made of the EPDM rubber. The resulting golf ball has high resiliency, a soft feel, and good weather-resistance.

Brief Review of the Related Art

Multi-piece solid golf balls having a core and surrounding cover are generally known in the industry. Basically, a two-piece solid golf ball includes a solid inner core protected by an outer cover. The inner core is made commonly of a rubber material such as natural and synthetic rubbers: styrene butadiene, polybutadiene, poly (cis-isoprene), or poly (trans-isoprene). The outer cover is made commonly of a thermoplastic such as ionomer resins, polyamides, and polyesters; and thermoplastic and thermoset polyurethane and polyurea elastomers. As new materials and manufacturing processes have become more economically feasible, three-piece, four-piece, and five-piece solid golf balls have been introduced. Both professional and amateur golfers enjoy these multi-piece golf balls because of their properties and playing performance. Different materials can be used to impart specific properties and playing features to the ball.

Multi-layered covers are used normally in constructing these multi-piece balls. For example, the ball may include an inner cover layer made of an ethylene-based acid copolymer ionomer resin that helps impart hardness to the ball. These acid copolymer ionomers contain inter-chain ionic bonding and are generally made of an α-olefin such as ethylene and a vinyl comonomer having an acid group such as methacrylic, acrylic acid, or maleic acid. Metal ions such as sodium, lithium, zinc, and magnesium are used to neutralize the acid groups in the copolymer. Commercially available ethylene-based ionomer resins are available in various grades and identified based on type of base resin, molecular weight, and type of metal ion, amount of acid, degree of neutralization, additives, and other properties. The outer cover layer, which is disposed about the inner cover layer, may be made from a variety of materials including ionomers, polyamides, polyesters, and thermoplastic and thermoset polyurethane and polyureas. In recent years, golf balls having thin polyurethane covers have become more popular, because such covers tend to provide the ball with a "soft feel." In general, these balls provide the player with a more natural feel and sensation when he/she strikes the ball with the club face as opposed to balls having a more plastic and "hard feel."

Various cover materials are known in the industry. For example, Nesbitt, U.S. Pat. No. 6,303,704 discloses golf balls having covers made of non-ionomeric resins that have been subjected to cross-linking by peroxide cross-linking agents such as dicumyl peroxide or by irradiation such as gamma rays/electron beams. Numerous resin materials are listed including ethylene-ethyl acrylate, ethylene-methyl acrylate, ethylene-vinyl acetate, low density polyethylene, linear low density polyethylene, metallocene catalyzed polyolefins, polyamides, non-ionomeric acid copolymers, ethylene propylene elastomers such as EPR and EPDM, and syndiotactic resins such as syndiotactic 1,2-polybutadiene alone or in combination with other dienes. In one embodiment, a cover composition made from 100 parts ethylene-propylene-diene monomer and additives was cross-linked. The resulting composition was molded over a solid core to form a two-piece ball that was tested for scuff and cut-resistance.

Sullivan and Kaltenbacher, U.S. Pat. No. 5,857,926 discloses a cover layer formed from a composition comprising a blend of: 1) ionomeric copolymer; 2) ethylene-propylene-diene monomer; and 3) a copolymer formed from an α-olefin such as ethylene, acrylate ester such as methylacrylate, and acid such as methacrylic acid. The cover composition may be molded over a golf ball core (solid or wound) by injection molding or compression molding. Cores having one, two, or more layers can be used. According to the '926 Patent, the resulting ball has a high coefficient of restitution, soft cover, and excellent cut-resistance.

The industry continues looking for new cover materials for golf balls. It would be desirable to have a cover material that helps provides the ball with high resiliency. This would help the ball travel longer distances. At the same time, the cover material should provide the ball with a nice feel and playability. The cover material should not be excessively hard. Moreover, it would be desirable to have a cover material with high weather-resistance so the ball can resist cracking and thermal aging. The present invention provides golf balls having covers with such properties as well as other advantageous characteristics and features.

SUMMARY OF THE INVENTION

The present invention provides a multi-piece golf ball comprising at least one component made of an ethylene-propylene-diene copolymer (EPDM) rubber composition. In one embodiment, the ball contains a solid core of at least one layer and a cover enclosing the core. Preferably, the cover includes inner and outer cover layers, wherein the inner cover layer is formed of an ethylene-based acid copolymer ionomer resin and the outer cover is formed of a rubber composition comprising an EPDM rubber. The EPDM composition further comprises a polymerization initiator and reactive cross-linking co-agent and it is subjected to a cross-linking reaction.

In the EPDM rubber compositions, the polymerization initiator is preferably a peroxide and the cross-linking co-agent is preferably a metal salt of an α, β unsaturated carboxylic acid. Preferably, the EPDM rubber composition further comprises filler selected from the group consisting of polymeric, metal, and mineral fillers and mixtures thereof. In a dual-core construction, the inner core normally has a diameter of about 0.40 to about 1.55 inches, and the outer core normally has a thickness of about 0.020 to about 0.150 inches. The core normally has an overall diameter of about 1.45 to about 1.59 inches.

In the dual-covers, the inner cover layer may have a surface hardness of 60 Shore D or greater, and the outer cover layer may have a surface hardness of 20 to 70 Shore D, wherein the hardness of the inner cover layer is greater than the hardness of the outer cover. Preferably, the inner cover layer is formed from an ionomeric resin, comprising a copolymer of α-olefin, $C_3$ to $C_8$ α, β-ethylenically unsaturated mono-or dicarboxylic acid, and optional softening monomer. The ionomeric resin may be an E/X/Y copolymer, wherein E is ethylene; X is a $C_3$ to $C_8$ α, β-ethylenically unsaturated mono- or dicarboxylic acid; and Y is a softening monomer. For example, copolymers selected from the group consisting of: ethylene/(meth)acrylic acid/n-butyl acrylate; ethylene/(meth)acrylic acid/ethyl acrylate; ethylene/(meth) acrylic acid/methyl acrylate; ethylene/(meth)acrylic acid/n-butyl acrylate; and ethylene/(meth)acrylic acid/isobutyl acrylate copolymers may be used. High acid ionomers containing greater than 16 weight percent acid groups may be used as well as low acid ionomers. The acid groups may be neutralized greater than 70% and preferably greater than 90%.

In another embodiment, the outer cover is formed from a first rubber composition comprising EPDM copolymer rubber so that the outer cover has a hardness of 55 Shore D or less. Meanwhile, the inner cover is formed from a second rubber composition comprising EPDM copolymer rubber so that the inner cover has a hardness of 55 Shore D or greater.

The EPDM rubber composition may further contain an elastomer selected from the group consisting of polybutadiene, ethylene-propylene rubber, polyisoprene, styrene-butadiene rubber, polyalkenamers, butyl rubber, halobutyl rubber, polystyrene elastomers, polyethylene elastomers, polyurethane elastomers, polyurea elastomers, metallocene-catalyzed elastomers and plastomers, copolymers of isobutylene and p-alkylstyrene, halogenated copolymers of isobutylene and p-alkylstyrene, copolymers of butadiene with acrylonitrile, polychloroprene, alkyl acrylate rubber, chlorinated isoprene rubber, acrylonitrile chlorinated isoprene rubber, and mixtures thereof.

In one embodiment, the golf ball contains a dual-core comprising an inner core (center) and surrounding outer core layer. The inner core has a geometric center and outer surface, while the outer core layer has an inner surface and outer surface. The material hardness of the inner core is preferably greater than the outer surface hardness of the outer core layer. Preferably, an EPDM rubber composition is used to form the outer core layer and a polybutadiene rubber is used to form the inner core. In one version, the center hardness of the inner core is in the range of about 75 Shore C to about 90 Shore C units, and the outer surface of the outer core is preferably in the range of about 50 to about 70 Shore C. Preferably, the center hardness of the inner core is in the range of about 52 to about 98 Shore C units and the surface hardness of the outer core is in the range of about 50 to 96 Shore C units. More preferably, the center hardness is about 80 Shore C or greater, and the surface hardness of the outer core is about 80 Shore C or less.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

DETAILED DESCRIPTION OF THE INVENTION

Figure 1:
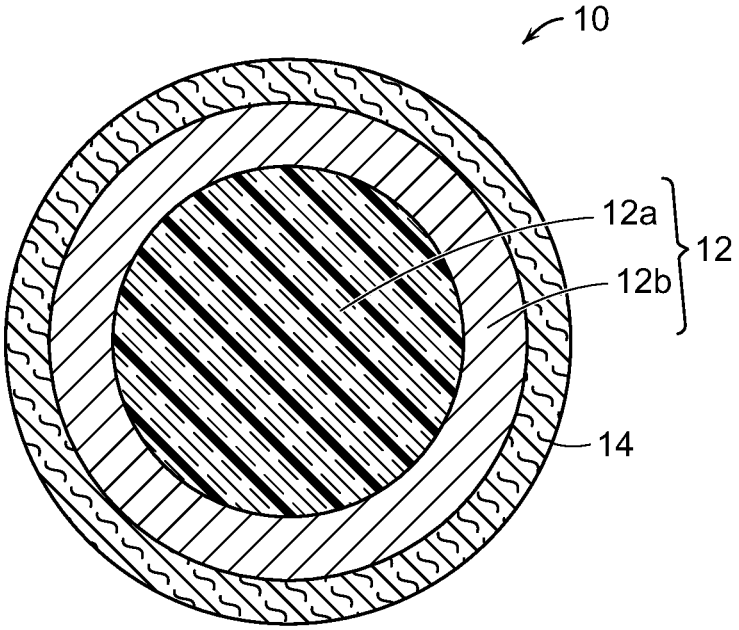
FIG. 1 is a cross-sectional view of a three-piece golf ball having an inner core and a dual-cover comprising inner and outer cover layers, the outer cover layer being formed of an EPDM rubber composition.

The present invention relates generally to golf balls containing at least one component made from a composition comprising ethylene-propylene-diene copolymer (EPDM) rubber. The golf ball may contain a single core or dual-core comprising an inner core (center) and surrounding outer core layer. Preferably, the ball includes a dual-cover comprising inner cover and outer cover layers, the inner cover layer being made of an ethylene-based acid copolymer ionomer and the outer cover layer being made of a rubber composition comprising EPDM.

Golf balls having various constructions may be made in accordance with this invention. For example, golf balls having three-piece, four-piece, and five-piece constructions with dual or three-layered cores and cover materials may be made The term, "layer" as used herein means generally any spherical portion of the golf ball. More particularly, in one version, a three-piece golf ball comprising a "dual-core" and cover is made. In another version, a four-piece golf ball comprising a dual-core and "dual-cover" is made. The dual-core includes an inner core (center) and surrounding outer core layer. The dual-cover includes inner cover and outer cover layers. In yet another construction, a five-piece golf ball having a dual-core, intermediate layer, and dual-cover is made. As used herein, the term, "intermediate layer" means a layer of the ball disposed between the core and cover. The intermediate layer may be considered an outer core layer, or inner cover layer, or any other layer disposed between the inner core and outer cover of the ball. The intermediate layer also may be referred to as a casing or mantle layer. A ball sub-assembly comprising an inner core, optional outer core, and optional intermediate layer may be made and a single-layered or multi-layered cover may be applied over the sub-assembly per this invention to make the final ball assembly. In accordance with the present invention, at least one of the core, intermediate, and cover layers of the golf ball is formed from the rubber composition of this invention. The diameter and thickness of the different layers along with properties such as hardness and compression may vary depending upon the construction and desired playing performance properties of the golf ball.

Ethylene-Propylene-Diene Copolymer Rubber

Preferably, the outer cover layer is formed of a first rubber composition comprising ethylene-propylene-diene (EPDM) copolymer rubber. In one version, the catalyzed EPDM rubber comprises from about 70% to about 90% by weight of ethylene and about 1 to about 5% ethylidene-2-norborene.

The EPDM rubber may have a relatively high or low Mooney viscosity. A "Mooney unit" is an arbitrary unit used to measure the viscosity of raw or non-vulcanized rubber. In the present invention, the Mooney viscosity is measured in accordance with "Standard Test Methods for Rubber-Viscosity, Stress Relaxation, and Pre-Vulcanization Characteristics (Mooney Viscometer)" of ASTM D1646-07. In general, EPDM rubbers of higher molecular weight and higher Mooney viscosity have better resiliency than EPDM rubbers of lower molecular weight and lower Mooney viscosity. However, as the Mooney viscosity increases, the milling and processing of the EPDM rubber generally becomes more difficult. In general, the lower limit of Mooney viscosity may be 30 or 35 or 40 or 45 or 50 or 55 or 60 or 70 or 75 and the upper limit may be 80 or 85 or 90 or 95 or 100 or 105 or 110 or 115 or 120 or 125 or 130. Blends of high and low Mooney viscosity EPDM copolymer rubbers may be prepared.

Examples of commercially available EPDM rubbers that can be used in accordance with this invention include, but are not limited to, NORDEL IP, available from Dow Chemical (Midland, Mich.); BUNA EP, available from Lanxess Corp. (Pittsburgh, Pa.); VISTALON, available from ExxonMobil (Irving, Tex.); and Royalene and RoyalEdge, available from Lion CoPolymer (Baton Rouge, La.). Maleic anhydride-modified EPDM such as RoyalFlex and silicone-modified EPDM such as Royaltherm, available from Lion Copolymer, may be used. In other instances, as discussed further below, a liquid EPDM rubber such as TRILENE, available from Lion Copolymer, may be used.

The EPDM rubber material (base rubber) may be blended with other elastomers in accordance with this invention. Other elastomers include, but are not limited to, polybutadiene, polyisoprene, ethylene propylene rubber ("EPR"), styrene-butadiene rubber, styrenic block copolymer rubbers (such as "SI", "SIS", "SB", "SBS", "SIBS", and the like, where "S" is styrene, "I" is isobutylene, and "B" is butadiene), polyalkenamers such as, for example, polyoctenamer, butyl rubber, halobutyl rubber, polystyrene elastomers, polyethylene elastomers, polyurethane elastomers, polyurea elastomers, metallocene-catalyzed elastomers and plastomers, copolymers of isobutylene and p-alkylstyrene, halogenated copolymers of isobutylene and p-alkylstyrene, copolymers of butadiene with acrylonitrile, polychloroprene, alkyl acrylate rubber, chlorinated isoprene rubber, acrylonitrile chlorinated isoprene rubber, and combinations of two or more thereof.

The EPDM rubber is used in an amount of at least about 50% by weight based on total weight of composition and is generally present in an amount of about 50% to about 100%, or an amount within a range having a lower limit of 50% or 60% or 70% and an upper limit of 80% or 90% or 100%. Preferably, the concentration of EPDM rubber is about 50 to about 75 weight percent and more preferably about 55 to about 70 weight percent.

In one preferred embodiment, a liquid EPDM rubber is used. The liquid rubber composition may be a relatively low molecular weight pure liquid polymer such as TRILENE liquid EPDM rubber, available from Lion Copolymer. Or, the liquid rubber may contain be a latex material containing an emulsion of rubber globules in water. In one version, the liquid rubber is a latex material containing about 30% to about 70% solids. As described in co-pending, co-assigned U.S. patent application Ser. No. 12/717,543, the disclosure of which is incorporated by reference, the liquid rubber composition may be a latex material that, when in a solid state, can be extended under ambient conditions at least twice its resting length, and upon stress release can return to within 15% of its original length. The latex material may form a heavy latex film with about 30% to about 70% solids and applied using submersion times of about 10 seconds to about 60 seconds. The preferred method of application of the latex is submersion of the core in a bath; however, other methods can be used. It is useful in this invention that the liquid dry to a reasonably tack-free film or a film which can be rendered tack-free by exposure to heat or radiation. However, a heavy latex film can be formed with less than 30% solids, if the submersion time is increased accordingly or with more than 70% solids if the submersion time is decreased accordingly. The preferred heavy latex material has about 52% solids and is applied using a submersion time of about 30 seconds. The liquid rubber composition typically has a viscosity of about 10,000 cp or less, more preferably from about 1,000 cp to 10,000 cp, or, optionally, about 1,000 cp or less.

More particularly, a liquid rubber composition may be prepared in accordance with this invention based on liquid ethylene-propylene-diene terpolymer (EPDM). The composition is liquid at ambient temperatures (which refers to the temperature of the surroundings and is normally about −20° to about 40° C.), and is applied to the ball sub-assembly at ambient temperatures. Normally, the liquid composition will be applied at room temperature (about 15° to about 25° C.). As discussed above, the EPDM rubbers are terpolymers of ethylene, propylene, and non-conjugated diene. Preferably, the non-conjugated diene which is used in the EPDM terpolymer is selected from the group consisting of cover composition of the invention preferably includes ethylidene norbornene, 1,4 hexadiene, or dicyclopentadiene (DCPD). As discussed further below, the liquid rubber composition can comprise reinforcing agents such as carbon black and silica, free-radical curing initiators such as organic peroxides; reactive cross-linking co-agents such as zinc diacrylate (ZDA), and soft and fast agents such as zinc pentachlorothiophenol (ZnPCTP). Plasticizing oils, for example, paraffin or naphthalene hydrocarbon oils that are used to adjust the viscosity and other properties of the liquid rubber can be added. Any compatible solvent such as aliphatic and aromatic hydrocarbons, which can be used to adjust the liquid's viscosity, also may be used. When a long storage life for the liquid rubber compositions of this invention is needed, the curative component can be kept separate from EPDM polymer component and then mixed together immediately prior to use.

The EPDM-based liquid rubber composition of the present invention also can contain rubber particulate such as, for example, polybutadiene rubber, polyisoprene, ethylene propylene rubber ("EPR"), styrene-butadiene rubber, or styrenic block copolymer rubbers. For example, the particulate polybutadiene rubber is preferably present in the liquid rubber composition in an amount of 1 to 60 percent by weight (weight %). In one embodiment, the polybutadiene rubber particulate is present in an amount of 5 to 40 weight %, and in another embodiment, in an amount of 8 to 32% by weight, and in yet another embodiment, in an amount of 12 to 25%. The polybutadiene or other rubber particulate helps to reinforce the composition. The polybutadiene rubber particulate preferably has an average particle size of 0.1 to 10 μm, more preferably 0.1 to 5 μm, and is dispersed in the liquid rubber composition. It is important that the polybutadiene rubber particulate be dispersed uniformly and completely in the liquid rubber composition. High-shear mixing of the particulate may be required. In one embodiment, the polybutadiene rubber is already polymerized; thus, when the cross-linking agent is added, only the EPDM rubber is cross-linked. In another embodiment, the butadiene rubber is not polymerized; thus, when the cross-linking agent is added, the EPDM rubber and butadiene rubber particulate are cross-linked.

The liquid composition may be applied at ambient temperature and pressure by dip-coating, pouring, spraying, brushing, and the like. In a dip-coating process, a bath containing the liquid rubber composition is prepared and the ball sub-assembly is treated per the following steps: a) the ball sub-assembly is immersed in the bath under ambient temperature and pressure; b) the ball sub-assembly is pulled-up from the bath; c) a thin coating of the liquid rubber composition is deposited on the ball sub-assembly as it is being pulled out of the bath—the speed wherein the ball sub-assembly is withdrawn from the bath helps determine the thickness of the coating; and d) excess liquid rubber is drained from the surface of the ball sub-assembly as the sub-assembly is withdrawn. The liquid rubber coating is cured at ambient temperature. Heating the ball sub-assembly or using elevated temperatures to cure the ball sub-assembly is not required. Of course, external heat can be used if desired, and the liquid composition can be applied at any suitable temperature. It should be understood that the rate of cure will be slower at lower temperatures and faster at higher temperatures. When the liquid rubber composition is cured, it hardens and holds the shape of the outer cover.

In accordance with the present invention, golf balls containing dual-covers having an outer cover layer formed from a rubber composition comprising EPDM rubber have advantageous properties. Particularly, the EPDM rubber composition can be used to make an outer cover layer that provides the golf ball with good rebounding properties (distance) without sacrificing a nice feel to the ball. The resulting ball has a relatively high coefficient of restitution ("COR") allowing it to reach high velocity when struck by a golf club. Thus, the ball tends to travel a greater distance which is particularly important for driver shots off the tee. At the same time, the EPDM rubber composition is not excessively hard and it helps provide the ball with a soft and comfortable feel. The golf player experiences a better sense of control and natural feeling when striking the ball. Furthermore, the softer cover allows players to place a spin on the ball and better control its flight pattern. The ball has better playability. This is particularly important for approach shots near the green. Moreover, the EPDM rubber composition used to form the cover helps impart good weather-resistance to the ball. Thus, the ball should have good crack resistance and the effects of sunlight, and freezing and heated temperatures should be less harmful.

As discussed further below, the base (and dominant) component in the EPDM rubber composition is the EPDM copolymer rubber. The composition preferably further contains a cross-linking initiator agent such as peroxide and a reactive cross-linking co-agent such as zinc diacrylate, but these ingredients are added in lesser amounts. There is minimal amount of cross-linking in the EPDM rubber composition and this helps to impart a soft feel to the ball.

The liquid rubber composition also may contain Liquid NBR (acrylonitrile butadiene copolymers) and Liquid NBR terpolymers (with isoprene or carboxylated NBRs) are sold by the Zeon Corp of Japan as NIPOL N30L and DN601 (carboxylated) and DN1201 (terpolymer of acrylonitrile-butadiene-isoprene). Liquid isoprene rubber and copolymers thereof, such as LIR-30 (liquid isoprene), LIR-310 (styrene-isoprene), LIR-390 (butadiene-isoprene), LIR-403 and -410 (carboxylated isoprene), UC-1 (methacrylated isoprene), LIR-700 (latex isoprene), and LIR-300 (liquid BR), are suitable for the intermediate cover layers of the invention and are commercially-available from Kuraray Co. of Japan. Liquid polybutadiene resins, such as RICON 151(MW 2000), RICON 153 (MW 2800), and other RICON grades including RICON 131, 142, 184 (liquid SBR) and maleated versions like RICOBOND 1031, 1731 and 1756, are suitable for the intermediate cover layers of the invention and are commercially-available from Sartomer Materials.

Casting Method

A dip-coating method for forming the outer cover is described above. As an alternative, a casting method can be used. For example, in producing an outer cover layer, a liquid mixture of EPDM rubber is prepared. As discussed above, the mixture may contain reinforcing agents such as carbon black and silica, free-radical curing initiators such as organic peroxides; reactive cross-linking co-agents such as zinc diacrylate (ZDA), and soft and fast agents such as zinc pentachlorothiophenol (ZnPCTP). Plasticizing oils, for example, paraffin or naphthalene hydrocarbon oils that are used to adjust the viscosity and other properties of the liquid rubber also can be added. Any compatible solvent such as aliphatic and aromatic hydrocarbons, which can be used to adjust the liquid's viscosity, may be used. Also, the mixture may contain rubber particulate such as polybutadiene rubber. The mixture can be poured into lower and upper mold members (half-shells), which may be pre-heated (normally at a temperature of about 125° to about 300° F.).

Next, the golf ball sub-assembly structure is lowered at a controlled speed into the liquid rubber reactive mixture. Ball suction cups can hold the core structure in place via reduced pressure or partial vacuum. Then, the vacuum is removed and the sub-assembly is released into the mold cavity. Then, the upper mold member is mated with the lower mold member. Finally, the molded balls are cooled in the mold and removed when the molded cover is hard enough so that it can be handled without deforming.

After the golf balls have been removed from the mold, they may be subjected to finishing steps such as flash-trimming, surface-treatment, marking, coating, and the like using techniques known in the art. For example, in traditional white-colored golf balls, the white-pigmented cover may be surface-treated using a suitable method such as, for example, corona, plasma, or ultraviolet (UV) light-treatment. Then, indicia such as trademarks, symbols, logos, letters, and the like may be printed on the ball's cover using pad-printing, ink-jet printing, dye-sublimation, or other suitable printing methods. Clear surface coatings (for example, primer and top-coats), which may contain a fluorescent whitening agent, are applied to the cover. The resulting golf ball has a glossy and durable surface finish.

In another finishing process, the golf balls are painted with one or more paint coatings. For example, white primer paint may be applied first to the surface of the ball and then a white top-coat of paint may be applied over the primer. Of course, the golf ball may be painted with other colors, for example, red, blue, orange, and yellow. Markings such as trademarks and logos may be applied to the painted cover of the golf ball. Finally, a clear surface coating may be applied to the cover to provide a shiny appearance and protect any logos and other markings printed on the ball.

Figure 4:
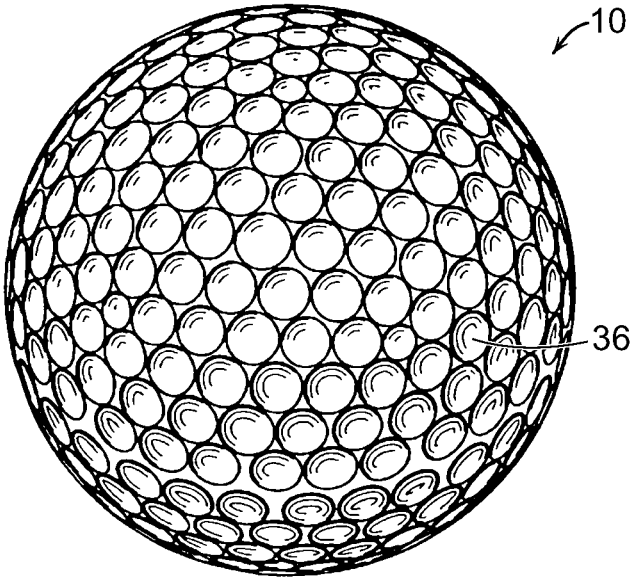
FIG. 4 is a front view of a golf ball having a dimpled cover made in accordance with the present invention.

Referring to FIG. 4, one version of a golf ball that can be made in accordance with this invention is generally indicated at (10). Various patterns and geometric shapes of dimples (36) are used to modify the aerodynamic properties of the golf ball (10). The dimples (36) can be arranged on the outer surface of the ball (10) in various patterns to modify the aerodynamic properties of the ball as discussed in detail below.

As discussed above, the lower and upper mold cavities are mated together to form the outer cover layer for the ball. The outer cover material encapsulates the inner ball. The mold cavities used to form the outer layer have interior dimple cavity details. The cover material conforms to the interior geometry of the mold cavities to form a dimple pattern on the surface of the ball. The mold cavities may have any suitable dimple arrangement such as, for example, icosahedral, octahedral, cube-octahedral, dipyramid, and the like. In addition, the dimples may be circular, oval, triangular, square, pentagonal, hexagonal, heptagonal, octagonal, and the like. Possible cross-sectional shapes include, but are not limited to, circular arc, truncated cone, flattened trapezoid, and profiles defined by a parabolic curve, ellipse, semi-spherical curve, saucer-shaped curve, sine or catenary curve, or conical curve. Other possible dimple designs include dimples within dimples, constant depth dimples, or multi-lobe dimples, as disclosed in U.S. Pat. No. 6,749,525. It also should be understood that more than one shape or type of dimple may be used on a single ball, if desired.

The use of various dimple patterns and profiles provides a relatively effective way to modify the aerodynamic characteristics of a golf ball. Suitable dimple patterns include, for example, icosahedron-based pattern, as described in U.S. Pat. No. 4,560,168; octahedral-based dimple patterns as described in U.S. Pat. No. 4,960,281; and tetrahedron-based patterns as described in co-assigned, co-pending, U.S. patent application Ser. No. 12/894,827, the disclosure of which is hereby incorporated by reference. Other tetrahedron-based dimple designs are shown in co-assigned, co-pending design applications D 29/362,123; D 29/362,124; D 29/362,125; and D 29/362,126, the disclosures of which are hereby incorporated by reference.

The total number of dimples on the ball, or dimple count, may vary depending such factors as the sizes of the dimples and the pattern selected. In general, the total number of dimples on the ball preferably is between about 100 to about 1000 dimples, although one skilled in the art would recognize that differing dimple counts within this range can significantly alter the flight performance of the ball. In one embodiment, the dimple count is about 300-360 dimples. In one embodiment, the dimple count on the ball is about 360-400 dimples.

It should be understood that both the dip-coating and casting methods for forming the rubber outer cover are significantly different than conventional injection-molding methods, where a molding machine is used to make molded parts. In general, injection-molding involves the steps of: a) feeding molding powder into the heating chamber of the machine, which holds several times as much material as is necessary to fill the mold. The powder is heated to a viscous liquid; b) forcing an amount of molding powder that is just sufficient to fill the mold cavity into the rear of the heating chamber by a plunger, thus injecting an equal amount of liquid plastic from the front of the heating chamber into the mold; and c) keeping the liquid plastic material in the mold under high pressure until it cools and is then ejected.

Polybutadiene Rubber

Preferably, the inner core of the golf ball is formed of a second rubber composition comprising a polybutadiene rubber material. In one embodiment, the ball contains a single core formed of the polybutadiene rubber composition. In a second embodiment, the ball contains a dual-core comprising an inner core (center) and surrounding outer core layer. In yet another version, the golf ball contains a multi-layered core comprising an inner core, intermediate core layer, and outer core layer. Preferably, the inner core is made of a rubber composition comprising polybutadiene and the outer core layer is made of a rubber composition comprising EPDM.

In general, polybutadiene is a homopolymer of 1, 3-butadiene. The double bonds in the 1, 3-butadiene monomer are attacked by catalysts to grow the polymer chain and form a polybutadiene polymer having a desired molecular weight. Any suitable catalyst may be used to synthesize the polybutadiene rubber depending upon the desired properties. Normally, a transition metal complex (for example, neodymium, nickel, or cobalt) or an alkyl metal such as alkyllithium is used as a catalyst. Other catalysts include, but are not limited to, aluminum, boron, lithium, titanium, and combinations thereof. The catalysts produce polybutadiene rubbers having different chemical structures. In a cis-bond configuration, the main internal polymer chain of the polybutadiene appears on the same side of the carbon-carbon double bond contained in the polybutadiene. In a trans-bond configuration, the main internal polymer chain is on opposite sides of the internal carbon-carbon double bond in the polybutadiene. The polybutadiene rubber can have various combinations of cis- and trans-bond structures. A preferred polybutadiene rubber has a 1, 4 cis-bond content of at least 40%, preferably greater than 80%, and more preferably greater than 90%. In general, polybutadiene rubbers having a high 1, 4 cis-bond content have high tensile strength. The polybutadiene rubber may have a relatively high or low Mooney viscosity.

Examples of commercially available polybutadiene rubbers that can be used in accordance with this invention, include, but are not limited to, BR 01 and BR 1220, available from BST Elastomers of Bangkok, Thailand; SE BR 1220LA and SE BR1203, available from DOW Chemical Co of Midland, Mich.; BUDENE 1207, 1207s, 1208, and 1280 available from Goodyear, Inc of Akron, Ohio; BR 01, 51 and 730, available from Japan Synthetic Rubber (JSR) of Tokyo, Japan; BUNA CB 21, CB 22, CB 23, CB 24, CB 25, CB 29 MES, CB 60, CB Nd 60, CB 55 NF, CB 70 B, CB KA 8967, and CB 1221, available from Lanxess Corp. of Pittsburgh. Pa.; BR1208, available from LG Chemical of Seoul, South Korea; UBEPOL BR130B, BR150, BR150B, BR150L, BR230, BR360L, BR710, and VCR617, available from UBE Industries, Ltd. of Tokyo, Japan; EUROPRENE NEOCIS BR 60, INTENE 60 AF and P30AF, and EUROPRENE BR HV80, available from Polimeri Europa of Rome, Italy; AFDENE 50 and NEODENE BR40, BR45, BR50 and BR60, available from Karbochem (PTY) Ltd. of Bruma, South Africa; KBR 01, NdBr 40, NdBR-45, NdBr 60, KBR 710S, KBR 710H, and KBR 750, available from Kumho Petrochemical Co., Ltd. Of Seoul, South Korea; DIENE 55NF, 70AC, and 320 AC, available from Firestone Polymers of Akron, Ohio.

To form the core, the polybutadiene rubber is used in an amount of at least about 5% by weight based on total weight of composition and is generally present in an amount of about 5% to about 100%, or an amount within a range having a lower limit of 5% or 10% or 20% or 30% or 40% or 50% and an upper limit of 55% or 60% or 70% or 80% or 90% or 95% or 100%. Preferably, the concentration of polybutadiene rubber is about 45 to about 95 weight percent.

Curing of Rubber Compositions

The rubber compositions of this invention may be cured, either pre-blending or post-blending, using conventional curing processes. Suitable curing processes include, for example, peroxide-curing, sulfur-curing, high-energy radiation, and combinations thereof. Preferably, the rubber composition contains a free-radical initiator selected from organic peroxides, high energy radiation sources capable of generating free-radicals, and combinations thereof. In one preferred version, the rubber composition is peroxide-cured. Suitable organic peroxides include, but are not limited to, dicumyl peroxide; n-butyl-4,4-di(t-butylperoxy) valerate; 1,1-di(t-butylperoxy)3,3,5-trimethylcyclohexane; 2,5-dimethyl-2,5-di(t-butylperoxy) hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butylperoxyisopropyl)benzene; dilauroyl peroxide; dibenzoyl peroxide; t-butyl hydroperoxide; and combinations thereof. In a particular embodiment, the free radical initiator is dicumyl peroxide, including, but not limited to Perkadox® BC, commercially available from Akzo Nobel. Peroxide free-radical initiators are generally present in the rubber composition in an amount of at least 0.05 parts by weight per 100 parts of the total rubber, or an amount within the range having a lower limit of 0.05 parts or 0.1 parts or 1 part or 1.25 parts or 1.5 parts or 2.5 parts or 5 parts by weight per 100 parts of the total rubbers, and an upper limit of 2.5 parts or 3 parts or 5 parts or 6 parts or 10 parts or 15 parts by weight per 100 parts of the total rubber. Concentrations are in parts per hundred (phr) unless otherwise indicated. As used herein, the term, "parts per hundred," also known as "phr" or "pph" is defined as the number of parts by weight of a particular component present in a mixture, relative to 100 parts by weight of the polymer component. Mathematically, this can be expressed as the weight of an ingredient divided by the total weight of the polymer, multiplied by a factor of 100.

The rubber compositions may further include a reactive cross-linking co-agent. Suitable co-agents include, but are not limited to, metal salts of unsaturated carboxylic acids having from 3 to 8 carbon atoms; unsaturated vinyl compounds and polyfunctional monomers (e.g., trimethylolpropane trimethacrylate); phenylene bismaleimide; and combinations thereof. Particular examples of suitable metal salts include, but are not limited to, one or more metal salts of acrylates, diacrylates, methacrylates, and dimethacrylates, wherein the metal is selected from magnesium, calcium, zinc, aluminum, lithium, and nickel. In a particular embodiment, the co-agent is selected from zinc salts of acrylates, diacrylates, methacrylates, and dimethacrylates. In another particular embodiment, the agent is zinc diacrylate (ZDA). When the co-agent is zinc diacrylate and/or zinc dimethacrylate, the co-agent is typically included in the rubber composition in an amount within the range having a lower limit of 1 or 5 or 10 or 15 or 19 or 20 parts by weight per 100 parts of the total rubber, and an upper limit of 24 or 25 or 30 or 35 or 40 or 45 or 50 or 60 parts by weight per 100 parts of the base rubber.

Radical scavengers such as a halogenated organosulfur, organic disulfide, or inorganic disulfide compounds may be added to the rubber composition. These compounds also may function as "soft and fast agents." As used herein, "soft and fast agent" means any compound or a blend thereof that is capable of making a core: 1) softer (having a lower compression) at a constant "coefficient of restitution" (COR); and/or 2) faster (having a higher COR at equal compression), when compared to a core equivalently prepared without a soft and fast agent. Preferred halogenated organosulfur compounds include, but are not limited to, pentachlorothiophenol (PCTP) and salts of PCTP such as zinc pentachlorothiophenol (ZnPCTP). Using PCTP and ZnPCTP in golf ball inner cores helps produce softer and faster inner cores. The PCTP and ZnPCTP compounds help increase the resiliency and the coefficient of restitution of the core. In a particular embodiment, the soft and fast agent is selected from ZnPCTP, PCTP, ditolyl disulfide, diphenyl disulfide, dixylyl disulfide, 2-nitroresorcinol, and combinations thereof.

The rubber compositions of the present invention also may include "fillers," which are added to adjust the density and/or specific gravity of the material. Suitable fillers include, but are not limited to, polymeric or mineral fillers, metal fillers, metal alloy fillers, metal oxide fillers and carbonaceous fillers. Fillers can be in the form of flakes, fibers, fibrils, or powders. Regrind, which is ground, recycled core material (for example, ground to about 30 mesh particle size), can also be used. The amount and type of fillers utilized are governed by the amount and weight of other ingredients in the golf ball, since a maximum golf ball weight of 45.93 g (1.62 ounces) has been established by the United States Golf Association (USGA).

As discussed above, the golf ball preferably contains a dual-core comprising an inner core (center) and surrounding outer core layer. In one embodiment, the specific gravity of the center is preferably less than or equal to or substantially the same as the specific gravity of the outer core layer. For purposes of the present invention, specific gravities are substantially the same if they are the same or within 0.1 g/cc of each other. Preferably, the center has a specific gravity within a range having a lower limit of 0.50 or 0.90 or 1.05 or 1.13 g/cc and an upper limit of 1.15 or 1.18 or 1.20 g/cc. The outer core layer preferably has a specific gravity of 1.00 g/cc or greater, or 1.05 g/cc or greater, or 1.10 g/cc or greater. In one embodiment, the outer core has a specific gravity in the range of about 1.00 to about 1.18 g/cc. As discussed further below, if an intermediate core layer is present, it preferably has a specific gravity of 1.00 g/cc or greater, or 1.05 g/cc or greater, or 1.10 g/cc or greater. In a particularly preferred embodiment, the specific gravities of the center and outer core layer are substantially the same. In another particularly preferred embodiment, the specific gravities of the intermediate layer and outer core layer are substantially the same.

Suitable polymeric or mineral fillers include, for example, precipitated hydrated silica, clay, talc, asbestos, glass fibers, aramid fibers, mica, calcium metasilicate, barium sulfate, zinc sulfide, lithopone, silicates, silicon carbide, diatomaceous earth, polyvinyl chloride, carbonates such as calcium carbonate and magnesium carbonate. Suitable metal fillers include titanium, tungsten, aluminum, bismuth, nickel, molybdenum, iron, lead, copper, boron, cobalt, beryllium, zinc, and tin. Suitable metal alloys include steel, brass, bronze, boron carbide whiskers, and tungsten carbide whiskers. Suitable metal oxide fillers include zinc oxide, iron oxide, aluminum oxide, titanium oxide, magnesium oxide, and zirconium oxide. Suitable particulate carbonaceous fillers include graphite, carbon black, cotton flock, natural bitumen, cellulose flock, and leather fiber. Micro balloon fillers such as glass and ceramic, and fly ash fillers can also be used.

In addition, the rubber compositions may include antioxidants to prevent the breakdown of the elastomers. Also, processing aids such as high molecular weight organic acids and salts thereof, may be added to the composition. Suitable organic acids are aliphatic organic acids, aromatic organic acids, saturated mono-functional organic acids, unsaturated monofunctional organic acids, multi-unsaturated mono-functional organic acids, and dimerized derivatives thereof. Particular examples of suitable organic acids include, but are not limited to, caproic acid, caprylic acid, capric acid, lauric acid, stearic acid, behenic acid, erucic acid, oleic acid, linoleic acid, myristic acid, benzoic acid, palmitic acid, phenylacetic acid, naphthalenoic acid, dimerized derivatives thereof. The organic acids are aliphatic, mono-functional (saturated, unsaturated, or multi-unsaturated) organic acids. Salts of these organic acids may also be employed. The salts of organic acids include the salts of barium, lithium, sodium, zinc, bismuth, chromium, cobalt, copper, potassium, strontium, titanium, tungsten, magnesium, cesium, iron, nickel, silver, aluminum, tin, or calcium, salts of fatty acids, particularly stearic, behenic, erucic, oleic, linoelic or dimerized derivatives thereof. It is preferred that the organic acids and salts of the present invention be relatively non-migratory (they do not bloom to the surface of the polymer under ambient temperatures) and non-volatile (they do not volatilize at temperatures required for melt-blending.)

Other ingredients such as accelerators (for example, tetra methylthiuram), processing aids, dyes and pigments, wetting agents, surfactants, plasticizers, coloring agents, fluorescent agents, chemical blowing and foaming agents, defoaming agents, stabilizers, softening agents, impact modifiers, antioxidants, antiozonants, as well as other additives known in the art may be added to the rubber composition.

Other additives and fillers include, but are not limited to, chemical blowing and foaming agents, optical brighteners, coloring agents, fluorescent agents, whitening agents, UV absorbers, light stabilizers, defoaming agents, processing aids, antioxidants, stabilizers, softening agents, fragrance components, plasticizers, impact modifiers, titanium dioxide pigment, acid copolymer wax, surfactants, and fillers, such as zinc oxide, tin oxide, barium sulfate, zinc sulfate, calcium oxide, calcium carbonate, zinc carbonate, barium carbonate, tungsten, tungsten carbide, silica, lead silicate, regrind (recycled material), clay, mica, talc, nano-fillers, carbon black, glass flake, milled glass, and mixtures thereof. Suitable additives are more fully described in, for example, Rajagopalan et al., U.S. Patent Application Publication No. 2003/0225197, the entire disclosure of which is hereby incorporated herein by reference. In a particular embodiment, the total amount of additive(s) and filler(s) present in the rubber composition is 15 wt % or less, or 12 wt % or less, or 10 wt % or less, or 9 wt % or less, or 6 wt % or less, or 5 wt % or less, or 4 wt % or less, or 3 wt % or less, based on the total weight of the rubber composition. In a particular aspect of this embodiment, the rubber composition includes filler(s) selected from carbon black, nanoclays (e.g., Cloisite® and Nanofil® nanoclays, commercially available from Southern Clay Products, Inc., and Nanomax® and Nanomer® nanoclays, commercially available from Nanocor, Inc.), talc (e.g., Luzenac HAR® high aspect ratio talcs, commercially available from Luzenac America, Inc.), glass (e.g., glass flake, milled glass, and microglass), mica and mica-based pigments (e.g., Iriodin® pearl luster pigments, commercially available from The Merck Group), and combinations thereof. In a particular embodiment, the rubber composition is modified with organic fiber micropulp, as disclosed, for example, in Chen, U.S. Pat. No. 7,504,448, the entire disclosure of which is hereby incorporated by reference.

Covers

The cores of the golf balls may be enclosed with one or more cover layers so long as the outer cover layer is formed of the EPDM rubber composition. The ball preferably includes a dual-cover comprising inner and outer cover layers. The inner cover layer preferably has a material hardness of 95 Shore C or less, or less than 95 Shore C, or 92 Shore C or less, or 90 Shore C or less, or a material hardness within a range having a lower limit of 60 or 65 or 70 or 75 or 80 or 84 or 85 Shore C and an upper limit of 90 or 92 or 95 Shore C. In one preferred embodiment, the inner cover has a material hardness in the range of about 60 to about 90 Shore D. The thickness of the inner cover layer is preferably within a range having a lower limit of 0.010 or 0.015 or 0.020 or 0.030 inches and an upper limit of 0.035 or 0.045 or 0.080 or 0.120 inches. The outer cover layer preferably has a material hardness of 85 Shore C or less. In one preferred embodiment, the outer cover has a material hardness in the range of about 20 to about 80 Shore D. The thickness of the outer cover layer is preferably within a range having a lower limit of 0.010 or 0.015 or 0.025 inches and an upper limit of 0.035 or 0.040 or 0.055 or 0.080 inches. Preferably, the inner cover layer has a material hardness greater than the material hardness of the outer cover layer.

In one version, the outer cover layer has a midpoint hardness and outer hardness surface; and the hardness of the outer surface is greater than the hardness of the midpoint to define a positive hardness gradient. For example, the hardness of the outer cover surface can be in the range of about 35 to about 90 Shore D and the hardness of the midpoint can be in the range of about 30 to about 80 Shore D. In another version, the outer cover layer has a midpoint hardness and outer hardness surface, wherein the hardness of the outer surface is the same or greater than the hardness of the midpoint to define a zero or negative hardness gradient. For example, the hardness of the outer cover midpoint can be in the range of about 40 to about 75 Shore D and the hardness of the outer surface can be in the range of about 35 to about 70 Shore D.

A wide variety of materials may be used for forming the inner cover including, for example, polyurethanes; polyureas; copolymers, blends and hybrids of polyurethane and polyurea; olefin-based copolymer ionomer resins (for example, Surlyn® ionomer resins and DuPont HPF® 1000 and HPF® 2000, commercially available from DuPont; Iotek® ionomers, commercially available from ExxonMobil Chemical Company; Amplify® IO ionomers of ethylene acrylic acid copolymers, commercially available from The Dow Chemical Company; and Clarix® ionomer resins, commercially available from A. Schulman Inc.); polyethylene, including, for example, low density polyethylene, linear low density polyethylene, and high density polyethylene; polypropylene; rubber-toughened olefin polymers; acid copolymers, for example, poly(meth)acrylic acid, which do not become part of an ionomeric copolymer; plastomers; flexomers; styrene/butadiene/styrene block copolymers; styrene/ethylene-butylene/styrene block copolymers; dynamically vulcanized elastomers; copolymers of ethylene and vinyl acetates; copolymers of ethylene and methyl acrylates; polyvinyl chloride resins; polyamides, poly(amide-ester) elastomers, and graft copolymers of ionomer and polyamide including, for example, Pebax® thermoplastic polyether block amides, commercially available from Arkema Inc; cross-linked trans-polyisoprene and blends thereof; polyester-based thermoplastic elastomers, such as Hytrel®, commercially available from DuPont; polyurethane-based thermoplastic elastomers, such as Elastollan®, commercially available from BASF; synthetic or natural vulcanized rubber; and combinations thereof.

The inner cover layer is preferably formed from a composition comprising an ionomer or a blend of two or more ionomers that helps impart hardness to the ball. Suitable ionomer resins that may be used in the compositions of this invention are generally referred to as copolymers of α-olefin; $C_3$ to $C_8$ α, β-ethylenically unsaturated mono-or dicarboxylic acid; and optional softening monomer. The α-olefin is preferably ethylene or $C_3$ to $C_8$. These ionomers may be prepared by methods known in the art. Copolymers may include, without limitation, ethylene acid copolymers, such as ethylene/(meth)acrylic acid, ethylene/(meth)acrylic acid/maleic anhydride, ethylene/(meth)acrylic acid/maleic acid mono-ester, ethylene/maleic acid, ethylene/maleic acid mono-ester, ethylene/(meth)acrylic acid/n-butyl (meth)acrylate, ethylene/(meth)acrylic acid/iso-butyl (meth)acrylate, ethylene/(meth)acrylic acid/methyl (meth)acrylate, ethylene/(meth)acrylic acid/ethyl (meth)acrylate terpolymers, and the like. The term "copolymer," as used herein, includes polymers having two types of monomers, those having three types of monomers, and those having more than three types of monomers. Preferred α, β-ethylenically unsaturated mono- or dicarboxylic acids are (meth) acrylic acid, ethacrylic acid, maleic acid, crotonic acid, fumaric acid, itaconic acid. (Meth) acrylic acid is most preferred. As used herein, "(meth) acrylic acid" means methacrylic acid and/or acrylic acid. Likewise, "(meth) acrylate" means methacrylate and/or acrylate.

When a softening monomer is included, such copolymers are referred to herein as E/X/Y-type copolymers, wherein E is ethylene; X is a $C_3$ to $C_8$ α, β-ethylenically unsaturated mono- or dicarboxylic acid; and Y is a softening monomer. The softening monomer is typically an alkyl (meth) acrylate, wherein the alkyl groups have from 1 to 8 carbon atoms. Preferred E/X/Y-type copolymers are those wherein X is (meth) acrylic acid and/or Y is selected from (meth) acrylate, n-butyl (meth) acrylate, isobutyl (meth) acrylate, methyl (meth) acrylate, and ethyl (meth) acrylate. More preferred E/X/Y-type copolymers are ethylene/(meth) acrylic acid/n-butyl acrylate, ethylene/(meth) acrylic acid/methyl acrylate, and ethylene/(meth) acrylic acid/ethyl acrylate.

The amount of ethylene or $C_3$ to $C_6$ α-olefin in the acid copolymer is typically at least 15 wt. %, preferably at least 25 wt. %, more preferably least 40 wt. %, and even more preferably at least 60 wt. %, based on the total weight of the copolymer. The amount of $C_3$ to $C_8$ α, β-ethylenically unsaturated mono- or dicarboxylic acid in the acid copolymer is typically from 1 wt. % to 35 wt. %, preferably from 5 wt. % to 30 wt. %, more preferably from 5 wt. % to 25 wt. %, and even more preferably from 10 wt. % to 20 wt. %, based on the total weight of the copolymer. The amount of optional softening comonomer in the acid copolymer is typically from 0 wt. % to 50 wt. %, preferably from 5 wt. % to 40 wt. %, more preferably from 10 wt. % to 35 wt. %, and even more preferably from 20 wt. % to 30 wt. %, based on the total weight of the copolymer. "Low acid" and "high acid" ionomeric polymers, as well as blends of such ionomers, may be used. In general, low acid ionomers are considered to be those containing 16 wt. % or less of acid moieties, whereas high acid ionomers are considered to be those containing greater than 16 wt. % of acid moieties. In one version, the ionomer resin preferably contains greater than 5 wt. % acid moieties and more preferably greater than 11 wt. % acid moieties.

The acidic groups in the copolymeric ionomers are partially or totally neutralized with a cation source. Suitable cation sources include metal cations and salts thereof, organic amine compounds, ammonium, and combinations thereof. Preferred cation sources are metal cations and salts thereof, wherein the metal is preferably lithium, sodium, potassium, magnesium, calcium, barium, lead, tin, zinc, aluminum, manganese, nickel, chromium, copper, or a combination thereof. The amount of cation used in the composition is readily determined based on desired level of neutralization. For example, ionomeric resins having acid groups that are neutralized from about 10 percent to about 100 percent may be used. In one embodiment, the acid groups are partially neutralized. That is, the neutralization level is from about 10 to about 80%, more preferably 20 to 70%, and most preferably 30 to 50%. In another embodiment, the acid groups are highly or fully neutralized. That is, the neutralization level is from about 80 to about 100%, more preferably 90 to 100%, and most preferably 95 to 100%.

It is also known that organic acids or salts of organic acids, particularly fatty acids, may be added to the ionomer resin to help make the composition more processable. This may be accomplished by melt-blending an ethylene α,β-ethylenically unsaturated carboxylic acid copolymer, for example, with an organic acid or a salt of organic acid, and adding a sufficient amount of a cation source to increase the level of neutralization of all the acid moieties (including those in the acid copolymer and in the organic acid) to greater than 90%, (preferably greater than 100%). The organic acids may be aliphatic, mono- or multi-functional (saturated, unsaturated, or multi-unsaturated) organic acids. Salts of these organic acids may also be employed. The salts of organic acids of the present invention include the salts of barium, lithium, sodium, zinc, bismuth, chromium, cobalt, copper, potassium, strontium, titanium, tungsten, magnesium, cesium, iron, nickel, silver, aluminum, tin, or calcium, and salts of fatty acids, particularly stearic, behenic, erucic, oleic, linoelic or dimerized derivatives thereof. It is preferred that the organic acids and salts be relatively non-migratory (they do not bloom to the surface of the polymer under ambient temperatures) and non-volatile (they do not volatilize at temperatures required for melt-blending).

In a particular embodiment, the inner cover layer is formed from a composition comprising a high acid ionomer. A particularly suitable high acid ionomer is Surlyn 8150® (DuPont). Surlyn 8150® is a copolymer of ethylene and methacrylic acid, having an acid content of 19 wt %, which is 45% neutralized with sodium. In another particular embodiment, the inner cover layer is formed from a composition comprising a high acid ionomer and a maleic anhydride-grafted non-ionomeric polymer. A particularly suitable maleic anhydride-grafted polymer is Fusabond 525D® (DuPont). Fusabond 525D® is a maleic anhydride-grafted, metallocene-catalyzed ethylene-butene copolymer having about 0.9 wt % maleic anhydride grafted onto the copolymer. A particularly preferred blend of high acid ionomer and maleic anhydride-grafted polymer is an 84 wt %/16 wt % blend of Surlyn 8150® and Fusabond 525D®. Blends of high acid ionomers with maleic anhydride-grafted polymers are further disclosed, for example, in U.S. Pat. Nos. 6,992,135 and 6,677,401, the entire disclosures of which are hereby incorporated herein by reference.

In one preferred embodiment, the inner cover layer is formed from a composition comprising a 50/45/5 blend of Surlyn® 8940/Surlyn® 9650/Nucrel® 960, and, in a particularly preferred embodiment, has a material hardness of from 80 to 85 Shore C. In another particular embodiment, the inner cover layer is formed from a composition comprising a 50/25/25 blend of Surlyn® 8940/Surlyn® 9650/Surlyn® 9910, preferably having a material hardness of about 90 Shore C. In another version, a blend of 50% Surlyn® 7940 and 50% Surlyn® 8940 is used to form the inner cover. In yet another particular embodiment, the inner cover layer is formed from a composition comprising a 50/50 blend of Surlyn® 8940/Surlyn® 9650, preferably having a material hardness of about 86 Shore C. Surlyn® 8940 is an ethylene/methacrylic acid copolymer in which the MAA acid groups have been partially neutralized with sodium ions. Surlyn® 9650 and Surlyn® 9910 are two different grades of ethylene/methacrylic acid copolymer in which the MAA acid groups have been partially neutralized with zinc ions. Surlyn® 7940 is a copolymer of about 85% ethylene and 15% methacrylic acid that has been neutralized with lithium ions. Nucrel® 960 is an ethylene/methacrylic acid copolymer resin nominally made with 15 wt % methacrylic acid, and available from DuPont.

As discussed above, the single or multi-layered core is preferably enclosed with a dual-cover layer. In one embodiment, a multi-layered cover comprising inner and outer cover layers is formed, where the inner cover layer has a thickness of about 0.01 inches to about 0.06 inches, more preferably about 0.015 inches to about 0.040 inches, and most preferably about 0.02 inches to about 0.035 inches. In this version, the inner cover layer is formed from a partially- or fully-neutralized ionomer having a Shore D hardness of greater than about 55, more preferably greater than about 60, and most preferably greater than about 65. The outer cover layer, in this embodiment, preferably has a thickness of about 0.015 inches to about 0.055 inches, more preferably about 0.02 inches to about 0.04 inches, and most preferably about 0.025 inches to about 0.035 inches, with a hardness of about Shore D 70 or less, more preferably 60 or less, and most preferably about 55 or less. The inner cover layer is harder than the outer cover layer in this version.

In another version, the outer cover is formed from a first rubber composition comprising EPDM copolymer rubber, a polymerization initiator, and a reactive cross-linking agent as discussed above so that the outer cover has a hardness of 55 Shore D or less. Meanwhile, the inner cover is formed from a second rubber composition comprising EPDM copolymer rubber, a polymerization initiator, and a reactive cross-linking agent so that the inner cover has a hardness of 55 Shore D or greater. In this embodiment, the same polymerization initiator and reactive cross-linking agent used to form the inner cover layer can be used to form the outer cover layer; provided, however, that the inner cover layer has a hardness of 55 Shore D or greater and the outer cover layer has a hardness of 55 Shore D or less.

Cores

The golf balls of this invention may contain single or multi-layered cores. As discussed above, a polybutadiene rubber composition is preferably used to form the core. Other suitable thermosetting and thermoplastic materials can be used to form the core if desired, such as, for example, polyurethanes, polyureas, partially or fully neutralized ionomers, thermosetting polydiene rubber such as polyisoprene or ethylene-propylene rubber or ethylene-propylene-diene rubber natural rubber, balata, butyl rubber, halobutyl rubber, styrene butadiene rubber or any styrenic block copolymer such as styrene ethylene butadiene styrene rubber, and the like, and metallocene or other single-site catalyzed polyolefins, and combinations of two or more thereof. These other thermosetting and thermoplastic materials can be used in place of the polybutadiene rubber or can be mixed with the polybutadiene to form a blend. In one preferred embodiment, the golf ball contains a dual-core comprising an inner core (center) and surrounding outer core layer. The inner core is preferably formed of a polybutadiene rubber composition and surrounding outer core is preferably formed of an EPDM rubber composition.

In one preferred embodiment, the core is single-layered and formed from a second thermoset rubber composition. In another preferred embodiment, the core may comprise an inner core and outer core layer, wherein the inner core is formed from a second thermoset rubber composition as described above. The second and third thermoset rubber compositions preferably comprises a rubber selected from the group consisting of polybutadiene, ethylene-propylene-diene rubber, polyisoprene, styrene-butadiene rubber, polyalkenamers, butyl rubber, halobutyl rubber, polychloroprene, alkyl acrylate rubber, chlorinated isoprene rubber, acrylonitrile chlorinated isoprene rubber, and mixtures thereof.

Preferably, the polybutadiene rubber-based inner core has a center hardness (CH) within a range having a lower limit of 20 or 25 or 30 or 35 or 40 or 45 or 50 or 55 Shore C and an upper limit of 60 or 65 or 70 or 75 or 80 or 85 or 90 or 95 Shore C. And, preferably, the EPDM rubber-based outer core layer has a surface hardness (OCLSH) within a range having a lower limit of 20 or 25 or 30 or 35 or 40 or 45 or 50 or 55 Shore C and an upper limit of 60 or 65 or 70 or 75 or 80 or 85 or 90 or 95 Shore C. In one embodiment, the center hardness of the inner core layer is greater than the surface hardness of the outer core layer. In one preferred embodiment, the center hardness of the inner core is in the range of about 52 to about 98 Shore C units and the surface hardness of the outer core is in the range of about 50 to about 96 Shore C units. More particularly, in one version, the center hardness of the inner core is about 80 Shore C units or greater and the surface hardness of the outer core is about 80 Shore C units or less. In this embodiment, the center hardness (inner core) is preferably at least 5 Shore C units greater than the surface hardness (outer core).

In another embodiment, the outer core has a surface hardness and the inner core has a surface hardness, and the hardness of the outer core's surface is greater than the hardness of the inner core's surface. For example, the outer core may have a surface hardness of 80 Shore C or greater and the inner core may have a surface hardness of 70 Shore C or greater.

The inner core preferably has a diameter within a range having a lower limit of 0.40 or 0.75 or 0.85 or 0.875 inches and an upper limit of 1.125 or 1.15 or 1.39 or 1.55 inches. The outer core layer encloses the inner core such that the two-layered core has an overall diameter within a range having a lower limit of 1.40 or 1.45 or 1.50 or 1.51 or 1.52 or 1.525 inches and an upper limit of 1.54 or 1.55 or 1.555 or 1.56 or 1.59 or 1.62 inches.

Golf Ball Constructions

As discussed above, the EPDM rubber compositions of this invention may be used with any type of ball construction known in the art. Such golf ball designs include, for example, three-piece, four-piece, and five-piece designs.

The core and cover compositions may be prepared using conventional mixing techniques. The core composition can be formed into an inner core structure by ordinary techniques such as, for example, injection or compression molding. After molding, the core structure is removed from the mold and its surface may be treated using techniques such as corona discharge, sand blasting, or grinding to improve adhesion of the surrounding layers. Injection molding or compression molding can be used to form an outer core layer and/or inner cover layer about the inner core and produce an intermediate golf ball. The outer cover layer is subsequently molded over the inner cover layer to produce a golf ball.

In compression molding, the outer core and/or inner cover composition is formed into smooth surfaced hemispherical shells which are then positioned around the core in a mold having the desired inner cover thickness and subjected to compression molding under heat followed by cooling. This process fuses the shells together to form a unitary intermediate ball. Alternatively, the intermediate balls may be produced by injection molding, wherein the outer core and/or inner cover layer is injected directly around the core placed at the center of an intermediate ball mold under heat and pressure. After molding, the golf balls produced may undergo various further processing steps such as buffing, painting and marking using conventional techniques to make a finished ball.

Figure 2:
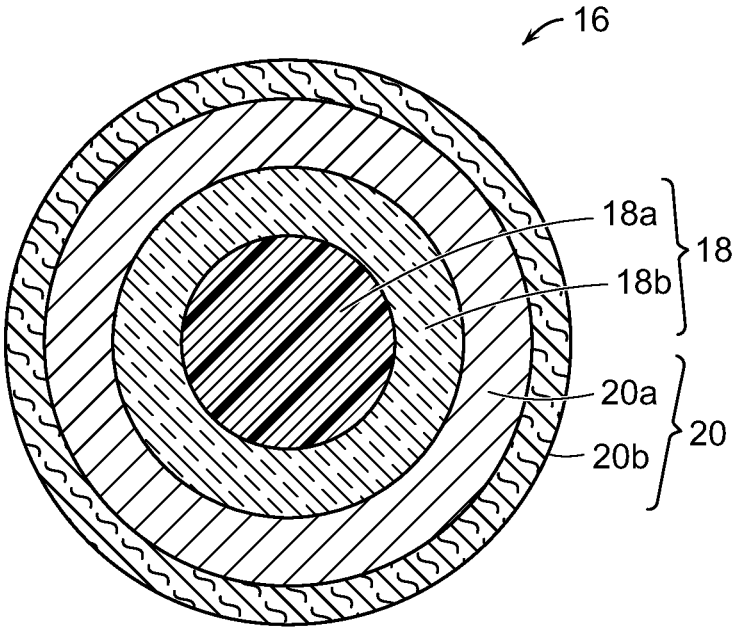
FIG. 2 is a cross-sectional view of a four-piece golf ball having a dual-core comprising an inner core and outer core layer and dual-cover comprising inner and outer cover layers, wherein the outer cover layer is made of an EPDM rubber composition.

Referring to FIG. 1, one version of a golf ball that can be made in accordance with this invention is generally indicated at (10). The ball (10) contains a core (12) surrounded by a dual-cover (14) comprising inner and outer cover layers (14*a*, 14*b*). In FIG. 2, a golf ball (16) containing a dual-core (18) with an inner core (center) (18*a*) and outer core layer (18*b*) surrounded by a dual-cover (20).having inner and outer cover layers (20*a*, 20*b*) is shown. It also is recognized that golf balls containing other multi-layered cores may be made in accordance with this invention.

Figure 3:
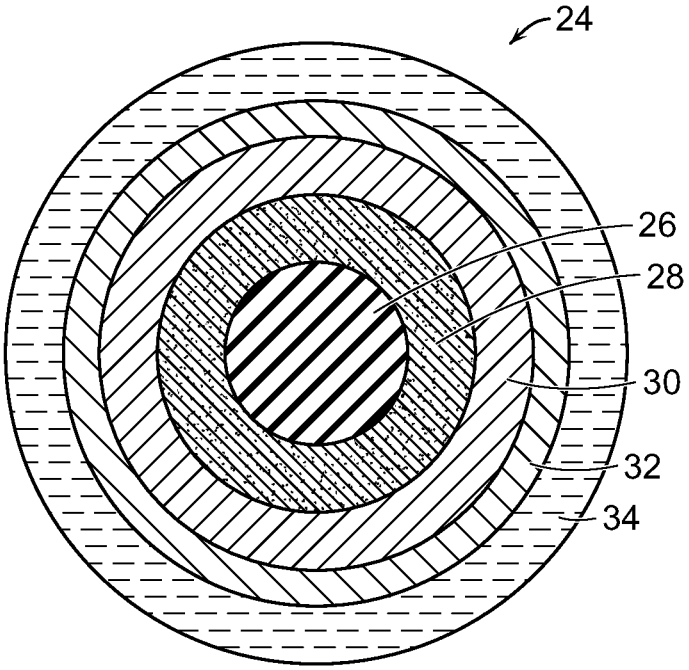
FIG. 3 is a cross-sectional view of a five-piece golf ball having a three layered-core comprising an inner core, intermediate core layer, and outer core and a cover comprising inner and outer cover layers, wherein the outer cover layer is made of made of an EPDM rubber composition.

For example, in FIG. 3, a golf ball (24) containing an inner core (center) (26), an intermediate core layer (28), and an outer core layer (30) is shown. The cover comprises inner and outer cover layers (32, 34). In this multi-layered core construction, the center (26) preferably has a diameter within a range having a lower limit of 0.100 or 0.125 or 0.250 inches and an upper limit of 0.375 or 0.400 or 0.500 or 0.750 or 1.00 inches. The intermediate core layer (28) preferably has a thickness within a range having a lower limit of 0.050 or 0.100 or 0.150 or 0.200 inches and an upper limit of 0.300 or 0.350 or 0.400 or 0.500 inches. The outer core layer (30) encloses the center (26) and intermediate core layer (28) structure such that the multi-layer core has an overall diameter within a range having a lower limit of 1.40 or 1.45 or 1.50 or 1.55 inches and an upper limit of 1.58 or 1.60 or 1.62 or 1.66 inches.

The center (26) preferably has an outer surface hardness of 70 Shore C or greater, more preferably a surface hardness of 80 Shore C or greater, and most preferably a surface hardness of 85 Shore C or greater. For example, the center (26) may have an outer surface hardness within a range having a lower limit of 70 or 75 or 80 Shore C and an upper limit of 90 or 95 Shore C. The outer core layer (30) preferably has an outer surface hardness that is less than that of the center and is preferably 50 Shore C or less; or 60 Shore C or less; or 70 Shore C or less; or 75 Shore C or less; or 80 Shore C or less. The intermediate layer preferably has an inner surface hardness greater than that of the center and outer core layer hardness values. Preferably, the intermediate layer has a surface hardness of 80 Shore C or greater.

In FIG. 4, a finished golf ball (10) having a cover containing a dimpled pattern (36) is shown. Various dimple patterns (36), as known in the art, may be used to modify the aerodynamic properties of the ball.

It should be understood the golf balls shown in FIGS. 1-4 are for illustrative purposes only and not meant to be restrictive. It should be recognized that other golf ball constructions can be made in accordance with this invention.

Test Methods

Hardness. The center hardness of a core is obtained according to the following procedure. The core is gently pressed into a hemispherical holder having an internal diameter approximately slightly smaller than the diameter of the core, such that the core is held in place in the hemispherical portion of the holder while concurrently leaving the geometric central plane of the core exposed. The core is secured in the holder by friction, such that it will not move during the cutting and grinding steps, but the friction is not so excessive that distortion of the natural shape of the core would result. The core is secured such that the parting line of the core is roughly parallel to the top of the holder. The diameter of the core is measured 90 degrees to this orientation prior to securing. A measurement is also made from the bottom of the holder to the top of the core to provide a reference point for future calculations. A rough cut is made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' surface is ground to a smooth, flat surface, revealing the geometric center of the core, which can be verified by measuring the height from the bottom of the holder to the exposed surface of the core, making sure that exactly half of the original height of the core, as measured above, has been removed to within 0.004 inches. Leaving the core in the holder, the center of the core is found with a center square and carefully marked and the hardness is measured at the center mark according to ASTM D-2240. Additional hardness measurements at any distance from the center of the core can then be made by drawing a line radially outward from the center mark, and measuring the hardness at any given distance along the line, typically in 2 mm increments from the center. The hardness at a particular distance from the center should be measured along at least two, preferably four, radial arms located 180° apart, or 90° apart, respectively, and then averaged. All hardness measurements performed on a plane passing through the geometric center are performed while the core is still in the holder and without having disturbed its orientation, such that the test surface is constantly parallel to the bottom of the holder, and thus also parallel to the properly aligned foot of the durometer.

The outer surface hardness of a golf ball layer is measured on the actual outer surface of the layer and is obtained from the average of a number of measurements taken from opposing hemispheres, taking care to avoid making measurements on the parting line of the core or on surface defects, such as holes or protrusions. Hardness measurements are made pursuant to ASTM D-2240 "Indentation Hardness of Rubber and Plastic by Means of a Durometer." Because of the curved surface, care must be taken to ensure that the golf ball or golf ball subassembly is centered under the durometer indenter before a surface hardness reading is obtained. A calibrated, digital durometer, capable of reading to 0.1 hardness units is used for the hardness measurements. The digital durometer must be attached to, and its foot made parallel to, the base of an automatic stand. The weight on the durometer and attack rate conforms to ASTM D-2240.

In certain embodiments, a point or plurality of points measured along the "positive" or "negative" gradients may be above or below a line fit through the gradient and its outermost and innermost hardness values. In an alternative preferred embodiment, the hardest point along a particular steep "positive" or "negative" gradient may be higher than the value at the innermost portion of the inner core (the geometric center) or outer core layer (the inner surface)—as long as the outermost point (i.e., the outer surface of the inner core) is greater than (for "positive") or lower than (for "negative") the innermost point (i.e., the geometric center of the inner core or the inner surface of the outer core layer), such that the "positive" and "negative" gradients remain intact.

As discussed above, the direction of the hardness gradient of a golf ball layer is defined by the difference in hardness measurements taken at the outer and inner surfaces of a particular layer. The center hardness of an inner core and hardness of the outer surface of an inner core in a single-core ball or outer core layer are readily determined according to the test procedures provided above. The outer surface of the inner core layer (or other optional intermediate core layers) in a dual-core ball are also readily determined according to the procedures given herein for measuring the outer surface hardness of a golf ball layer, if the measurement is made prior to surrounding the layer with an additional core layer. Once an additional core layer surrounds a layer of interest, the hardness of the inner and outer surfaces of any inner or intermediate layers can be difficult to determine. Therefore, for purposes of the present invention, when the hardness of the inner or outer surface of a core layer is needed after the inner layer has been surrounded with another core layer, the test procedure described above for measuring a point located 1 mm from an interface is used.

Also, it should be understood that there is a fundamental difference between "material hardness" and "hardness as measured directly on a golf ball." For purposes of the present invention, material hardness is measured according to ASTM D2240 and generally involves measuring the hardness of a flat "slab" or "button" formed of the material. Surface hardness as measured directly on a golf ball (or other spherical surface) typically results in a different hardness value. The difference in "surface hardness" and "material hardness" values is due to several factors including, but not limited to, ball construction (that is, core type, number of cores and/or cover layers, and the like); ball (or sphere) diameter; and the material composition of adjacent layers. It also should be understood that the two measurement techniques are not linearly related and, therefore, one hardness value cannot easily be correlated to the other. Shore hardness (for example, Shore C or Shore D hardness) was measured according to the test method ASTM D-2240.

Compression. As disclosed in Jeff Dalton's Compression by Any Other Name, Science and Golf IV, Proceedings of the World Scientific Congress of Golf (Eric Thain ed., Routledge, 2002) ("J. Dalton"), several different methods can be used to measure compression, including Atti compression, Riehle compression, load/deflection measurements at a variety of fixed loads and offsets, and effective modulus. For purposes of the present invention, "compression" refers to Atti compression and is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Very low stiffness cores will not cause the spring to deflect by more than 1.25 mm and therefore have a zero compression measurement. The Atti compression tester is designed to measure objects having a diameter of 42.7 mm (1.68 inches); thus, smaller objects, such as golf ball cores, must be shimmed to a total height of 42.7 mm to obtain an accurate reading. Conversion from Atti compression to Riehle (cores), Riehle (balls), 100 kg deflection, 130-10 kg deflection or effective modulus can be carried out according to the formulas given in J. Dalton. Compression may be measured as described in McNamara et al., U.S. Pat. No. 7,777,871, the disclosure of which is hereby incorporated by reference.

Coefficient of Restitution ("COR"). The COR is determined according to a known procedure, wherein a golf ball or golf ball subassembly (for example, a golf ball core) is fired from an air cannon at two given velocities and a velocity of 125 ft/s is used for the calculations. Ballistic light screens are located between the air cannon and steel plate at a fixed distance to measure ball velocity. As the ball travels toward the steel plate, it activates each light screen and the ball's time period at each light screen is measured. This provides an incoming transit time period which is inversely proportional to the ball's incoming velocity. The ball makes impact with the steel plate and rebounds so it passes again through the light screens. As the rebounding ball activates each light screen, the ball's time period at each screen is measured. This provides an outgoing transit time period which is inversely proportional to the ball's outgoing velocity. The COR is then calculated as the ratio of the ball's outgoing transit time period to the ball's incoming transit time period ($COR=V_{out}/V_{in}=T_{in}/T_{out}$).

The present invention is further illustrated by the following Examples, but these Examples should not be construed as limiting the scope of the invention.

EXAMPLES

In the following Examples A-C, three-piece golf ball balls were made. A polybutadiene-based solid core having a diameter of about 1.55 inches was made using conventional techniques. Each core was encapsulated with a Surlyn® ethylene-based acid copolymer ionomer resin to form an inner cover. The ball subassembly (core and inner cover) had a diameter of about 1.620 inches. Different EPDM-based rubber outer cover formulations were prepared and these formulations were molded over the subassemblies to form golf balls.

| Sample | Base Rubber (phr) | Secondary Rubber (phr) | ZDA or ZDMA Co-agent (phr) | Peroxide Free-Radical Initiator (phr) | Zinc Oxide Filler (phr) |
|---|---|---|---|---|---|
| A | 80 Parts Nordel IP 5565 | 20 parts Buna 1220 | 40 parts ZDA | 4.5 parts Varox 230XL | 5 parts ZnO |
| B | 80 parts Nordel IP 5565 | 20 parts Buna 1220 | 30 parts ZDA | 4.5 parts Varox 230XL | 5 parts ZnO |
| C | 80 parts Nordel IP 5565 | 20 parts Buna 1220 | 40 parts ZDMA | 4 parts Varox 230XL | 5 parts ZnO |

*Nordel ® IP 5565 - EPDM rubber available from Dow Chemical
*Buna ® 1220 - polybutadiene rubber available from Lanxess Corp.
*Varox ® 230 XL - peroxide granules available from R. T. Vanderbilt Co.

The resulting three-piece balls included an inner core, inner cover, and an EPDM-based outer cover, and each of the balls showed acceptable shear-durability.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention.

All patents, publications, test procedures, and other references cited herein, including priority documents, are fully incorporated by reference to the extent such disclosure is not inconsistent with this invention and for all jurisdictions in which such incorporation is permitted.

It is understood that the compositions and golf ball products described and illustrated herein represent only some embodiments of the invention. It is appreciated by those skilled in the art that various changes and additions can be made to compositions and products without departing from the spirit and scope of this invention. It is intended that all such embodiments be covered by the appended claims.

We claim:

1. A multi-layered golf ball comprising:

a ball sub-assembly comprising a solid core of at least one layer and surrounding inner cover layer, the inner cover layer having a material hardness in the range of about 60 to about 90 Shore D, wherein the inner cover layer is formed from an ionomeric resin comprising a copolymer of α-olefin, $C_3$ to $C_8$ α, β-ethylenically unsaturated mono-or dicarboxylic acid, and optional softening monomer; and an outer cover layer disposed about the sub-assembly, the outer cover layer being formed from a cured rubber composition comprising an ethylene-propylene-diene copolymer rubber, wherein the ethylene-propylene-diene copolymer rubber is liquid at ambient temperature prior to forming the outer cover layer and is present in an amount of from 60 wt % to 100 wt %, based on the total weight of the cured rubber composition and contains about 30 wt % to about 70 wt % solids;

wherein the outer cover layer has a material hardness in the range of about 20 to about 80 Shore D; and wherein the material hardness of the inner cover layer is greater than the material hardness of the outer cover layer.

2. The golf ball of claim 1, wherein the core is single-layered, the core being formed from a second cured rubber composition.

3. The golf ball of claim 2, wherein the second cured rubber composition comprises a rubber selected from the group consisting of polybutadiene, ethylene-propylene-diene rubber, polyisoprene, styrene-butadiene rubber, polyalkenamers, butyl rubber, halobutyl rubber, polychloroprene, alkyl acrylate rubber, chlorinated isoprene rubber, acrylonitrile chlorinated isoprene rubber, and mixtures thereof.

4. The golf ball of claim 1, wherein the outer cover layer has a midpoint hardness and outer hardness surface, the hardness of the outer surface being greater than the hardness of the midpoint to define a positive hardness gradient.

5. The golf ball of claim 4, wherein the hardness of the outer cover surface is in the range of about 35 to about 90 Shore D and the hardness of the midpoint is in the range of about 30 to about 80 Shore D.

6. The golf ball of claim 1, wherein the outer cover layer has a midpoint hardness and outer hardness surface, the hardness of the outer surface being the same or less than the hardness of the midpoint to define a zero or negative hardness gradient.

7. The golf ball of claim 6, wherein the hardness of the outer cover midpoint is in the range of about 40 to about 75 Shore D and the hardness of the outer surface is in the range of about 35 to about 70 Shore D.

8. The golf ball of claim 1, wherein the core is dual-layered, the core comprising an inner core and outer core layer, the inner core being formed from a second cured rubber composition, and the outer core layer being formed from a third cured rubber composition.

9. The golf ball of claim 8, wherein the third cured rubber composition comprises a rubber selected from the group consisting of polybutadiene, ethylene-propylene-diene rubber, polyisoprene, styrene-butadiene rubber, polyalkenamers, butyl rubber, halobutyl rubber, polychloroprene, alkyl acrylate rubber, chlorinated isoprene rubber, acrylonitrile chlorinated isoprene rubber, and mixtures thereof.

10. A multi-layered golf ball comprising:

a ball sub-assembly comprising a solid core of at least one layer and surrounding inner cover layer, the inner cover layer having a material hardness in the range of about 60 to about 90 Shore D, wherein the inner cover layer is formed from an ionomeric resin comprising a copolymer of α-olefin, $C_3$ to $C_8$ α, β-ethylenically unsaturated mono-or dicarboxylic acid, and optional softening monomer; and an outer cover layer disposed about the sub-assembly, the outer cover layer being formed from a cured rubber composition comprising an ethylene-propylene-diene copolymer rubber and polybutadiene, wherein the ethylene-propylene-diene copolymer rubber is liquid at ambient temperature prior to forming the outer cover layer and is present in an amount of at least 60 wt %, based on the total weight of the cured rubber composition and contains about 30 wt % to about 70 wt % solids;

wherein the outer cover layer has a material hardness in the range of about 20 to about 80 Shore D; and wherein the material hardness of the inner cover layer is greater than the material hardness of the outer cover layer.

11. The golf ball of claim 10, wherein the core is single-layered, the core being formed from a second cured rubber composition.

12. The golf ball of claim 11, wherein the second cured rubber composition comprises a rubber selected from the group consisting of polybutadiene, ethylene-propylene-diene rubber, polyisoprene, styrene-butadiene rubber, polyalkenamers, butyl rubber, halobutyl rubber, polychloroprene, alkyl acrylate rubber, chlorinated isoprene rubber, acrylonitrile chlorinated isoprene rubber, and mixtures thereof.

13. The golf ball of claim 10, wherein the core is dual-layered, the core comprising an inner core and outer core layer, the inner core being formed from a second cured rubber composition, and the outer core layer being formed from a third cured rubber composition.

14. The golf ball of claim 13, wherein the third cured rubber composition comprises a rubber selected from the group consisting of polybutadiene, ethylene-propylene-diene rubber, polyisoprene, styrene-butadiene rubber, polyalkenamers, butyl rubber, halobutyl rubber, polychloroprene, alkyl acrylate rubber, chlorinated isoprene rubber, acrylonitrile chlorinated isoprene rubber, and mixtures thereof.

* * * * *